US006277088B1

(12) United States Patent
Novella

(10) Patent No.: US 6,277,088 B1
(45) Date of Patent: Aug. 21, 2001

(54) PARTIAL INSOLE TO ACCOMMODATE A COMMON METATARSALGIA

(76) Inventor: Thomas Novella, 165 Perry St., Apt 2B, New York, NY (US) 10014

( * ) Notice: Subject to any disclaimer, the term of this patent is extended or adjusted under 35 U.S.C. 154(b) by 0 days.

(21) Appl. No.: 09/456,856

(22) Filed: Dec. 8, 1999

Related U.S. Application Data

(60) Provisional application No. 60/111,392, filed on Dec. 8, 1998.

(51) Int. Cl.[7] ..... A61F 13/00
(52) U.S. Cl. ..... 602/66; 36/145; 128/898
(58) Field of Search ..... 602/41, 66; 2/239, 2/240; 36/43, 44, 88, 93, 145; 128/898

(56) References Cited

U.S. PATENT DOCUMENTS 2,089,384 * 8/1937 Levitt .
2,613,456 * 10/1952 Amico .
4,669,142 * 6/1987 Meyer .
5,791,163 * 8/1998 Throneburg .

* cited by examiner

*Primary Examiner*—Michael A. Brown
*Assistant Examiner*—Lalita M Hamilton
(74) *Attorney, Agent, or Firm*—Nolte, Nolte & Hunter; Christopher Garvey

(57) ABSTRACT

An dispersive pad to accommodate a common metatarsalgia has a unitary pad of a flexible material such as neoprene. The pad is shaped to fit in a toe box of a shoe. The pad has a thin arch part, a thin toe part, and a thinner valley between the arch part and the toe part. The valley is defined by thicker pontoons on either side of the thinner valley.

7 Claims, 3 Drawing Sheets

Partial insole to accommodate a common metarsalgia

PARTIAL INSOLE TO ACCOMMODATE A COMMON METATARSALGIA

CROSS-REFERENCES TO RELATED APPLICATIONS

This application converts Provisional Application 60/111,392, filed Dec. 8, 1998, to a utility application.

STATEMENT AS TO RIGHTS TO INVENTIONS MADE UNDER FEDERALLY-SPONSORED RESEARCH AND DEVELOPMENT (IF ANY).

None.

BACKGROUND OF THE INVENTION.

1. Field of the Invention.

The present invention relates to a partial insole placed in the forepart of a shoe, to provide an excavation beneath the most frequently symptomatic site of the ball of the foot, the second metatarsal joint, thus relieving it of ground-reactive force, to reduce pain.

2. Description of Related Art Including Information Disclosed Under 37 CFR §§ 1.97 AND 1.98.

Various means have been used in attempts to relieve a frequent site of pain, at the ball of the foot. Having been a practicing and teaching podiatrist for twenty years I have become extremely familiar with the particular problem for which this invention is directed. Of the 100 patients I see per week, easily 20 will have had this problem. The problem has traditionally been referred to as "metatarsalgia" (meaning "pain at the ball of the foot") in the medical profession. In the dance and gymnastic communities it is called a "stone bruise" because it feels like the ball of the foot has focally and violently been embarrassed by a stone. Recent orthopedic literature has provided in-depth analysis of the condition. The condition is so common because many commonly-seen factors can cause it: such as bunions, hammer toes, weak toes, diabetes, high-arched feet, "Morton's" feet (those with long second metatarsals, the most common foot type of all), wearing high-heeled shoes, wearing thin-soled shoes, the inevitable thinning of the fat pad in the sole of the foot which occurs with age, flat feet, hypermobile ligaments, splay feet, overuse injuries from sports such as running, basketball, tennis, squash, aerobics, ballet, gymnastics, and cross-country skiing, and macro-traumatic events such as turf toe, joint dislocations, among others.

The single unifying factor in each of these circumstances is that it very well might focus inordinate ground-reactive force to the second joint at the ball of the foot, the second metatarsophalangeal joint. As this force continues, the ligament beneath the joint, called its "plantar plate", which is the entity most responsible for the stability of this joint, begins to thin out. In time the plantar plate micro-perforates and the second toe, having lost the entity responsible for its downward stability, loses its ability to "purchase" or competently grip the ground during stride. Thus, push-off forces are even further concentrated at the second ball joint, and pain ensues as the heel lifts during gait and weight transfers forward to the ball.

Of the 20,000 patients I've treated for this problem, 95% have tried some type of treatment before visiting me. The treatments they tried encompassed activity modification, such as cessation of pain-producing sports, or vastly-reduced amounts of walking, or limping, these are unsatisfactory because they compromise the normal lifestyle. Patients also tried shoe modification, such as reducing heel-height, wearing soft-soled shoes, or limiting themselves to the one or two pairs of shoes in their wardrobe which hurt the least; these strategies are not easily accepted due to societal requirements for wardrobe for business/dress, to psychological reasons (depression, self-esteem lowered), or for practical reasons (extreme difficulty and expense in finding satisfactory shoes or wasting money on unsatisfactory ones). Patients also tried over-the counter devices, such as padded inner soles, which deteriorate, take up a lot of room as often several layers are required for satisfactory effect, and do not specifically unweight the pain site, moleskin (adhesive pads taped to the pain site), which increases ground reaction and thus pain to the site, as do gel pads, or metatarsal pads (triangular, squat domes affixed within the shoe behind the pain site, towards the arch, which lose their functionality as soon as the heel elevates (the very moment when the pain site receives the greatest ground reaction is thus least protected with a metatarsal pad); to professional help, which can range from toe strengthening exercises (which often fail until the ball is protected because the patient refuses to stride into the toes if the ball is unprotected), to orthoses ($300–500 per pair lab-made custom in-shoe devices) with metatarsal pads affixed which don't frequently work due to the above mentioned rationale re met pads, to orthoses encompassing "pontoons", or thickening in the material of the orthosis in the forepart of the shoe which is precisely astride the pain site, thus enabling both a cavity beneath the pain site, reducing ground reaction there, as well as increasing ground reaction to the uninvolved metatarsophalangeal joints. In my experience this latter treatment, though expensive, time consuming and requiring both a doctor's visit as well as the awareness that one should visit (the right) doctor has a success rate well into the 90th percentile.

SUMMARY OF THE INVENTION.

The invention described herein is used to protect a frequent site of pain at the ball of the foot. The invention consists of one part, a partial innersole which is placed into the forepart of the shoe and is shaped to provide an excavation beneath the most frequently symptomatic site at the ball of the foot, the second metatarsophalangeal joint, thus relieving it of ground-reactive force, in order to reduce pain.

This invention essentially provides the "pontoon" portion of the orthosis in a ready-made, cheap, durable, over the counter product, which to my knowledge has never before been available. It will stay in place because it is cut to the inside dimensions of the typical toe box. It will be provided in four different sizes (women's small, women's medium/mens' small, women's large/men's medium, women's extra large/men's large), and can be used for either the left or right foot by simply turning it pontoons up or pontoons down.

The prototype was made of a single piece of 3 mm thick, 60 durometer neoprene rubber, a durable yet comfortable material which can be made thin enough to fit into a medium woman's dress shoe yet thick enough to provide adequate "pontooning", and will not pack down as might adhesive felt. In production the pad can be molded precisely to shape. The dimensions given in the drawing are for this particular prototype. Larger or smaller sizes will be proportionately scaled in 3 dimensions.

BRIEF DESCRIPTION OF THE DRAWINGS

FIGS. 4–11 are elevations in section through the planes indicated in FIG. 3 as 4–11.

DESCRIPTION OF THE PREFERRED EMBODIMENTS

Figure 1:
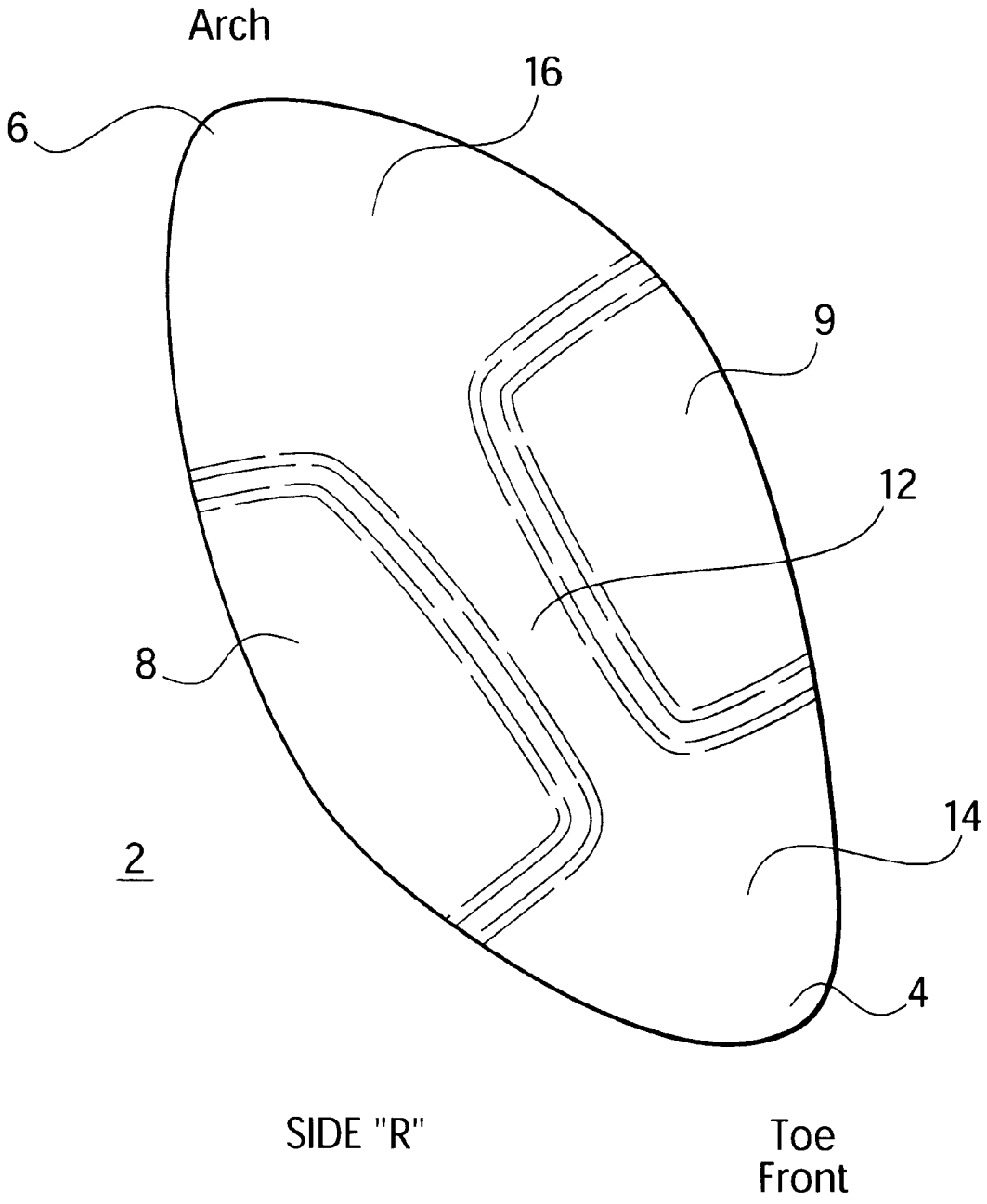
FIG. 1 is a top plan view of a dispersive pad of the present invention.

FIG. 1 is a plan view of a dispersive pad, generally designated 2, of the present invention. Dipersive pad 2 has a front 4 locatable at the patient's toe, and a rear 6, locatable at the patient's arch. Centered between front 4 and rear 6 are a pair of raised plateaus or pontoons 8 and 9, which define a valley 12 there-between. The dispersive pad is a single piece of 60 durometer neoprene such neoprene is commercially available in sheets specified as 55–60 durometer. For most people, the next softer commercially available hardness of 40–55 durometer would be too soft. EVA of similar durometer would be a functional equivalent of neoprene, as would similar materials.

Figure 2:
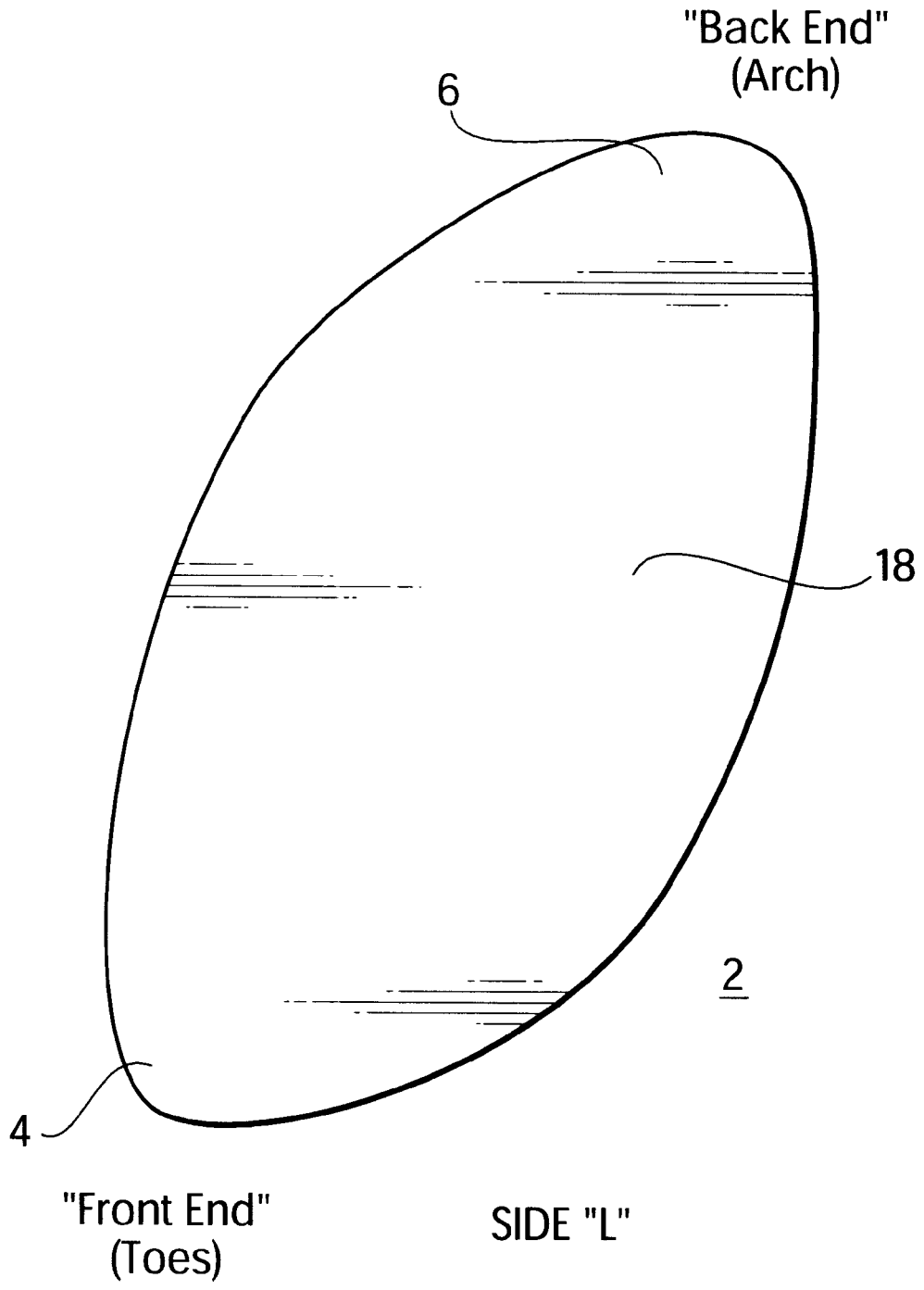
FIG. 2 is a bottom plan view thereof.

FIG. 2 shows the bottom 18 of the dispersive pad, which becomes the top when flipped for use as a left foot dispersive pad.

Figure 3:
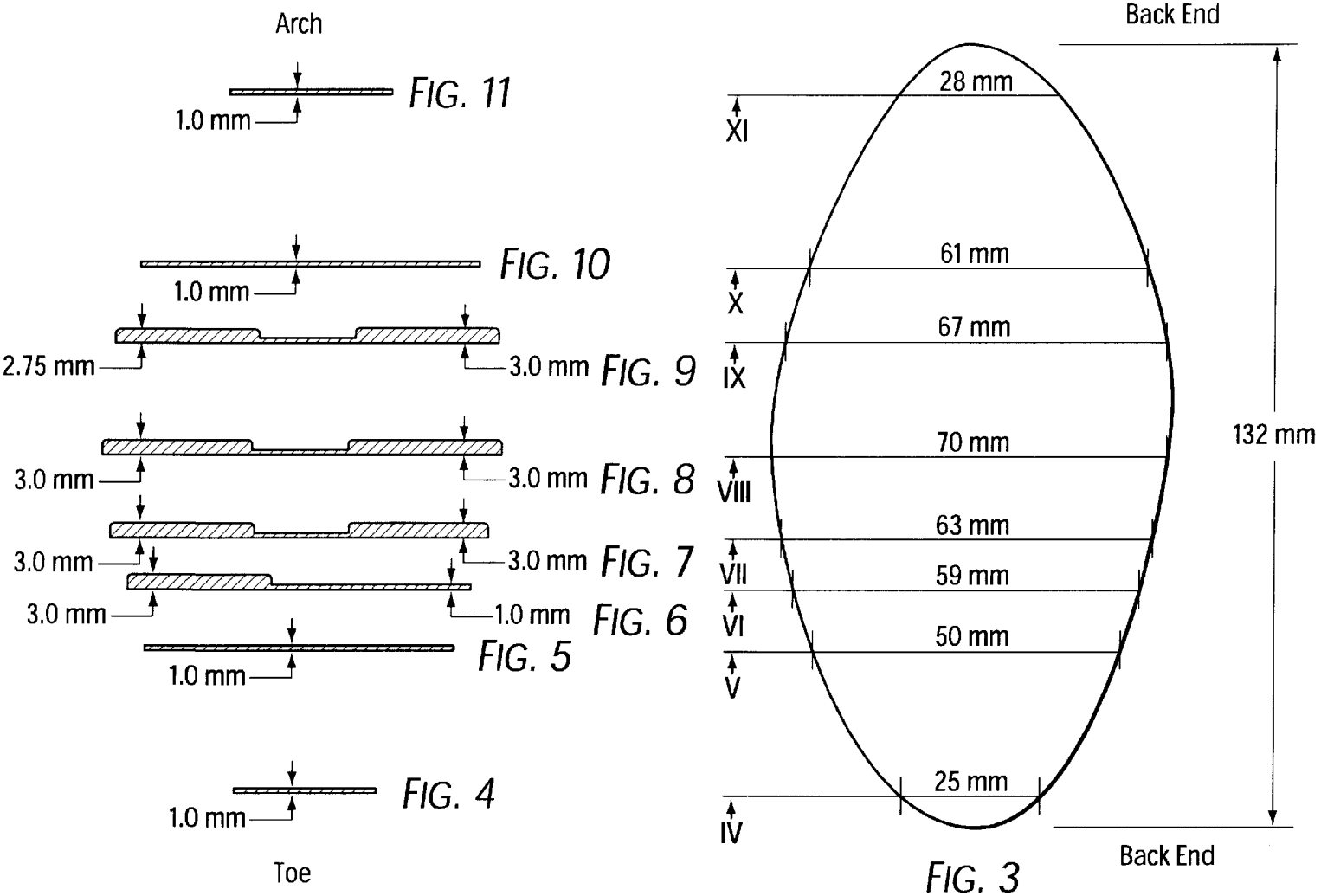
FIG. 3 is a plan view thereof without shading.

FIG. 3 shows a series of planes 4–11 and their distances from the toe end 20.

FIGS. 4–11 show how thicknesses vary from 0.75 mm in valley 12, to 1.0 mm in at the toe 14 and arch 16 portions, to 2.75–3.0 mm on pontoons 8–9 of the dispersive pad.

What is claimed is:

1. A dispersive pad to accommodate a common metatarsalgia, said dispersive pad comprising:

a unitary pad of a flexible material;

said pad selectively shaped to fit in a toe box of a shoe;

said pad having:

a thin arch part, a thin toe part, and a thinner valley between the arch part and the toe part, said valley defined by thicker pontoons on either side of the thinner valley.

2. A dispersive pad to accommodate a common metatarsalgia, said dispersive pad comprising:

a unitary pad of a flexible material;

said pad selectively shaped to fit in a toe box of a shoe;

said pad having:

a thin arch part, a thin toe part, and a thinner valley between the arch part and the toe part, said valley defined by thicker pontoons on either side of the thinner valley;

in which the pad is optimally approximately 55 to 60 durometer neoprene.

3. A dispersive pad to accommodate a common metatarsalgia, said dispersive pad comprising:

a unitary pad of a flexible material;

said pad selectively shaped to fit in a toe box of a shoe;

said pad having:

a thin arch part, a thin toe part, and a thinner valley between the arch part and the toe part.

said valley defined by thicker pontoons on either side of the thinner valley;

in which:

the arch part and the toe part are optimally 1 mm thick;

the valley is 0.75 mm thick; the pontoons are optimally from 2.75 mm to 3.0 mm thick.

4. A dispersive pad according to claim 3 in which the pad is optimally approximately 55 to 60 durometer neoprene.

5. A dispersive pad to accommodate a common metatarsalgia, said dispersive pad comprising:

a unitary pad of a flexible material;

said pad selectively shaped to fit in toe box of a shoe;

said pad having:

a thin arch part, a thin toe tart, and a thinner valley between the arch part and the toe part, said valley defined by thicker pontoons on either side of the thinner valley;

in which: one pontoon ranges in width from 25 mm toe-ward to 26 mm at the pontoon's center, to 25 mm arch-ward; and an other pontoon ranges in width from 22 mm toe-ward to 25 mm at the pontoon's center, to 23 mm arch-ward.

6. A dispersive pad to accommodate a common metatarsalgia, said dispersive pad comprising a unitary pad of a flexible material;

said pad selectively shaped to fit in a toe box of a shoe;

said pad having:

a pair of pontoons oriented longitudinally to the foot, for affording increased ground reaction at uninvolved metatarso phalangeal joints, namely at a first, a third, a fourth, and a fifth metatarso phalangeal joint, and a single thinner valley, oriented longitudinally to the foot, and disposed laterally between the pair of pontoons, said thinner valley for unloading a second metatarso phalangeal joint.

7. A dispersive pad according to claim 6 further having:

a thin arch part, thicker than the thinner valley, but thinner than the pontoons;

a thin toe part, thicker than the thinner valley, but thinner than the pontoons;

said toe part located fore and said arch part located aft of:

the valley, and the pair of pontoons.

* * * * *